US009690252B2

(12) United States Patent
Kusano et al.

(10) Patent No.: US 9,690,252 B2
(45) Date of Patent: Jun. 27, 2017

(54) IMAGE FORMING APPARATUS

(71) Applicant: CANON KABUSHIKI KAISHA, Tokyo (JP)

(72) Inventors: Yohei Kusano, Numazu (JP); Yoji Misao, Susono (JP); Shinkichi Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/695,882

(22) Filed: Apr. 24, 2015

(65) Prior Publication Data

US 2015/0309469 A1 Oct. 29, 2015

(30) Foreign Application Priority Data

Apr. 25, 2014 (JP) ..... 2014-091362

(51) Int. Cl.
*G03G 21/16* (2006.01)

(52) U.S. Cl.
CPC ..... *G03G 21/1647* (2013.01); *G03G 21/1633* (2013.01)

(58) Field of Classification Search
CPC ... H05K 5/0017; G06F 1/1679; G06F 1/1681; G03G 21/16; G03G 21/1628
See application file for complete search history.

(56) References Cited

U.S. PATENT DOCUMENTS 5,657,132 A * 8/1997 Samii ..... B41J 3/46 347/108
8,204,401 B2 6/2012 Tsuchiya
2007/0196128 A1* 8/2007 Ishihara ..... G03G 21/1628 399/125
2008/0157639 A1 7/2008 Jeong et al.
2008/0232050 A1* 9/2008 Muraki ..... G03G 15/5016 361/679.06
2011/0211223 A1* 9/2011 Ito ..... G03G 15/60 358/1.15
2011/0299884 A1* 12/2011 Uchida ..... G03G 15/60 399/110
2012/0013930 A1* 1/2012 Kondo ..... G03G 21/1628 358/1.13
2013/0014443 A1* 1/2013 Kim ..... G03G 21/1647 49/381
2013/0256970 A1* 10/2013 Nguyen ..... B65H 5/00 271/3.14
2014/0369713 A1 12/2014 Nakao et al.

FOREIGN PATENT DOCUMENTS

JP 2006-264281 A 10/2006
JP 2007-030216 A 2/2007
JP 2007-086733 A 4/2007
JP 2008-162087 A 7/2008
JP 2009-163054 A 7/2009
JP 2013-140199 A 7/2013

* cited by examiner

*Primary Examiner* — Sevan A Aydin

(74) *Attorney, Agent, or Firm* — Fitzpatrick, Cella, Harper & Scinto

(57) ABSTRACT

A second link member 47 has a protruding portion 48 and a first cover 42 has a bumped portion 42*a*. In an open state of the first cover 42, the protruding portion 48 and the bumped portion 42*a* abut against each other, thereby restricting the movement of the second link member 47 in a direction in which the display panel 41 is pressed.

12 Claims, 8 Drawing Sheets

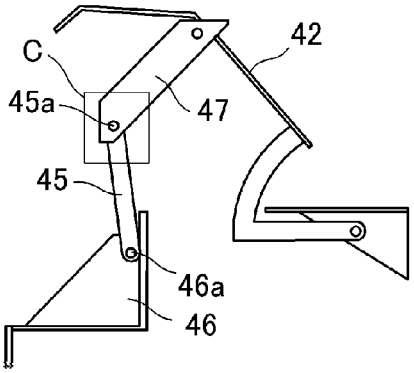
FIG.6A1
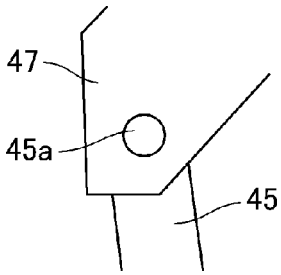
FIG.6A2
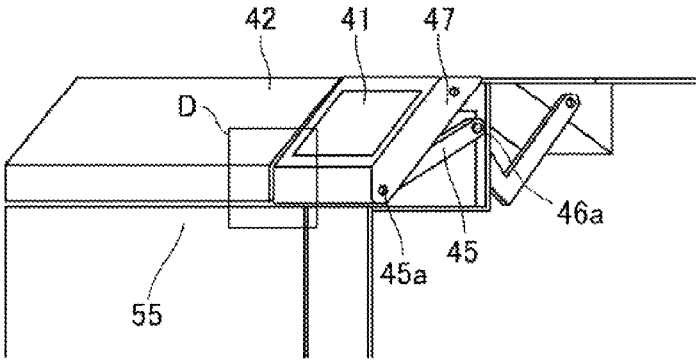
FIG.6B1
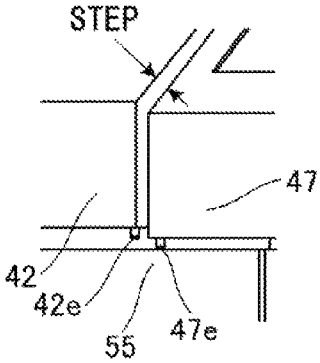
FIG.6B2
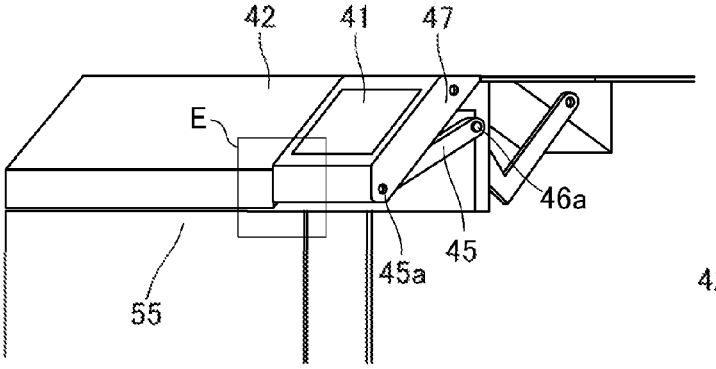
FIG.6C1
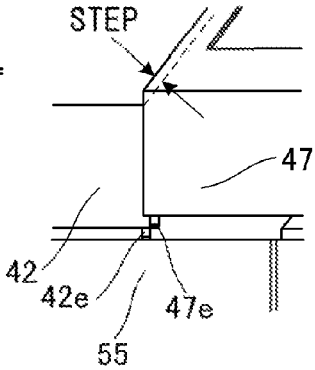
FIG.6C2

IMAGE FORMING APPARATUS

BACKGROUND OF THE INVENTION

Field of the Invention

The present invention relates to an image forming apparatus, such as a copying machine and a printer, which has a function of forming an image on a recording material such as a sheet.

Description of the Related Art

Some image forming apparatuses, such as a copying machine, a printer and a facsimile, may be provided with a display and operation panel unit including a display unit which instructs an operator on an operating method of a device, such as toner replenishment and removal of a jammed sheet, and an input unit used for performing the operation by the operator.

Since it is not always that the works such as the toner replenishment and the removal of a jammed sheet are performed by those skilled in the work, it is preferable that a worker can perform the work while watching the operation guidance displayed on the display screen.

Further, in recent years, there have been further increased requests, such as realization of miniaturization of products, and satisfactory arrangement of the display and operation panel from the viewpoint of design without projecting from the product, while a display unit that is larger than the related art is provided to improve the usability of the user.

To cope with such requests, in an apparatus having a display and operating unit, JP 2007-30216 discloses the following configuration. It is a configuration which enables an operator to perform the work while watching the image displayed on the display unit, and in which the display and operating unit moves to a position which does not interfere with the work during the work such as the toner replenishment and the removal of a jammed sheet (FIGS. 8A to 8C).

As illustrated in FIG. 8A, an image forming apparatus disclosed in JP 2007-30216 is provided with an upper cover member 201 which opens an inside of the image forming apparatus, a front cover member 202, and a display panel 210 which is attached to the upper cover member 201 to perform the display toward the outside of the image forming apparatus. As illustrated in FIG. 8B, the image forming apparatus is configured so that a display direction of the display panel 210 is substantially maintained, in a state in which the upper cover member 201 opens the inside of the image forming apparatus. This is due to the fact that, as illustrated in FIG. 8C, in conjunction with the opening and closing operation of the upper cover member 201 around a rotary shaft 221, the display panel 210 attached to the upper cover member 201 rotates around a rotary shaft 223. Specifically, in an image forming apparatus of JP 2007-30216, while a liquid crystal display unit displays the instructions to the operator in a state of facing the front of the operator when opening the inside of the image forming apparatus, the cover takes a posture different from the liquid crystal display unit during opening, and takes a posture which opens the front of the image forming apparatus. This makes it possible to provide a sufficient working space for the operator. Further, JP 2007-30216 discloses the provision of the following mechanism so as to reduce the number of operations of the operator. That is a mechanism in which an opening and closing member is made up of two members of an upper cover member 201 having a liquid crystal display unit, and a front cover member 202 not having the liquid crystal display unit, and when one member of them is opened and closed, the other member is opened and closed in conjunction therewith.

In many cases, in the vicinity of the above-described display unit, buttons for operating by being pressed by an operator, and in recent years, a touch panel type display unit has been provided. Therefore, in some cases, the operator may perform the operation when the opening and closing member is in the open state. Even in such a case, the rigidity of the operating unit is required as much as the operator can perform the operation.

SUMMARY OF THE INVENTION

An object of the present invention is to maintain the rigidity of an operating unit in a state in which an opening and closing member is opened.

Another object of the present invention is to provide an image forming apparatus comprising:

an opening and closing member which is movably provided with respect to an apparatus main body of the image forming apparatus to open and close the inside of the apparatus main body; and a movable member which has an operating unit, in which a pressing operation is performed, and is movably connected with respect to the opening and closing member, wherein the movable member moves in conjunction with the opening and closing operation of the opening and closing member to be able to open and close the inside of the apparatus main body, together with the opening and closing member, and wherein the movable member includes a bumping portion, the opening and closing member includes a bumped portion, and the bumping portion abuts against the bumped portion in an open state of the opening and closing member, thereby restricting the movement of the movable member in a direction in which the operating unit is pressed.

Another object of the present invention is to provide an image forming apparatus comprising:

an opening and closing member which is movably provided with respect to an apparatus main body of the image forming apparatus to open and close the inside of the apparatus main body; and a movable member which has an operating unit, in which a pressing operation is performed, and is connected so as to be movable with respect to the opening and closing member, wherein the movable member moves in conjunction with the opening and closing operation of the opening and closing member to be able to open and close the inside of the apparatus main body, together with the opening and closing member, and wherein the movable member includes a bumping portion, the apparatus main body includes a bumped portion, and the bumping portion abuts against the bumped portion in an open state of the opening and closing member, thereby restricting the movement of the movable member in a direction in which the operating unit is pressed.

Another object of the present invention is to provide an image forming apparatus comprising:

an opening and closing member which is provided to be movable between an open position where the inside of the apparatus main body is opened and a closed position where the inside of the apparatus main body is closed, with respect to an apparatus main body of the image forming apparatus;

a movable member which has an operating unit in which a pressing operation is performed, and is movably connected in conjunction with respect to the opening and closing member; and a connecting member connected to the movable member and the apparatus main body, wherein the movable member moves in conjunction with the opening and closing operation of the opening and closing member to be able to open and close the inside of the apparatus main body, together with the opening and closing member, wherein one of the movable member and the connecting member has a rotating portion, and the other thereof has a loose-fit portion to which the rotating portion is loosely fitted, and the rotating portion rotates with respect to the loss-fit portion along with the movement of the opening and closing member, and wherein backlash between the rotating portion and the loose-fit portion in the opening and closing direction of the movable member at the closed position is greater than backlash between the rotating portion and the loose-fit portion in the pressed direction of the operating unit at the open position.

Further features of the present invention will become apparent from the following description of exemplary embodiments (with reference to the attached drawings).

BRIEF DESCRIPTION OF THE DRAWINGS

FIGS. 6A1 to 6C2 are schematic diagrams for illustrating a subject of the fifth embodiment;

DESCRIPTION OF THE EMBODIMENTS

Figure 1A:
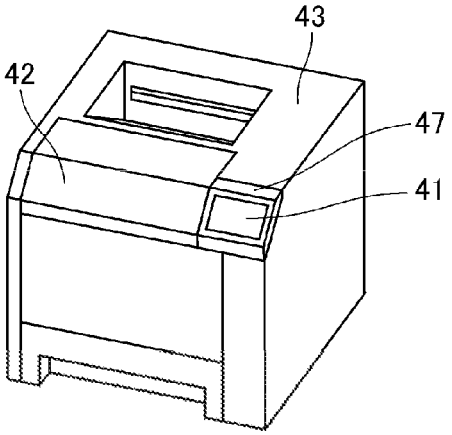
FIGS. 1A to 1D are diagrams for illustrating the features of an image forming apparatus of a first embodiment.

Embodiments of the present invention will now be described in detail referring to the drawings. However, dimensions, materials, shapes and relative positions of the components described in the embodiments can be appropriately changed by the configuration and various conditions of the apparatus to which the present invention is applied, and the scope of the present invention is not limited to the following embodiments.

Also, the configuration of the embodiments illustrated below can be combined with one another if possible.

First Embodiment

A first embodiment will be described below.

(Overall Configuration of Image Forming Apparatus)

Figure 7:
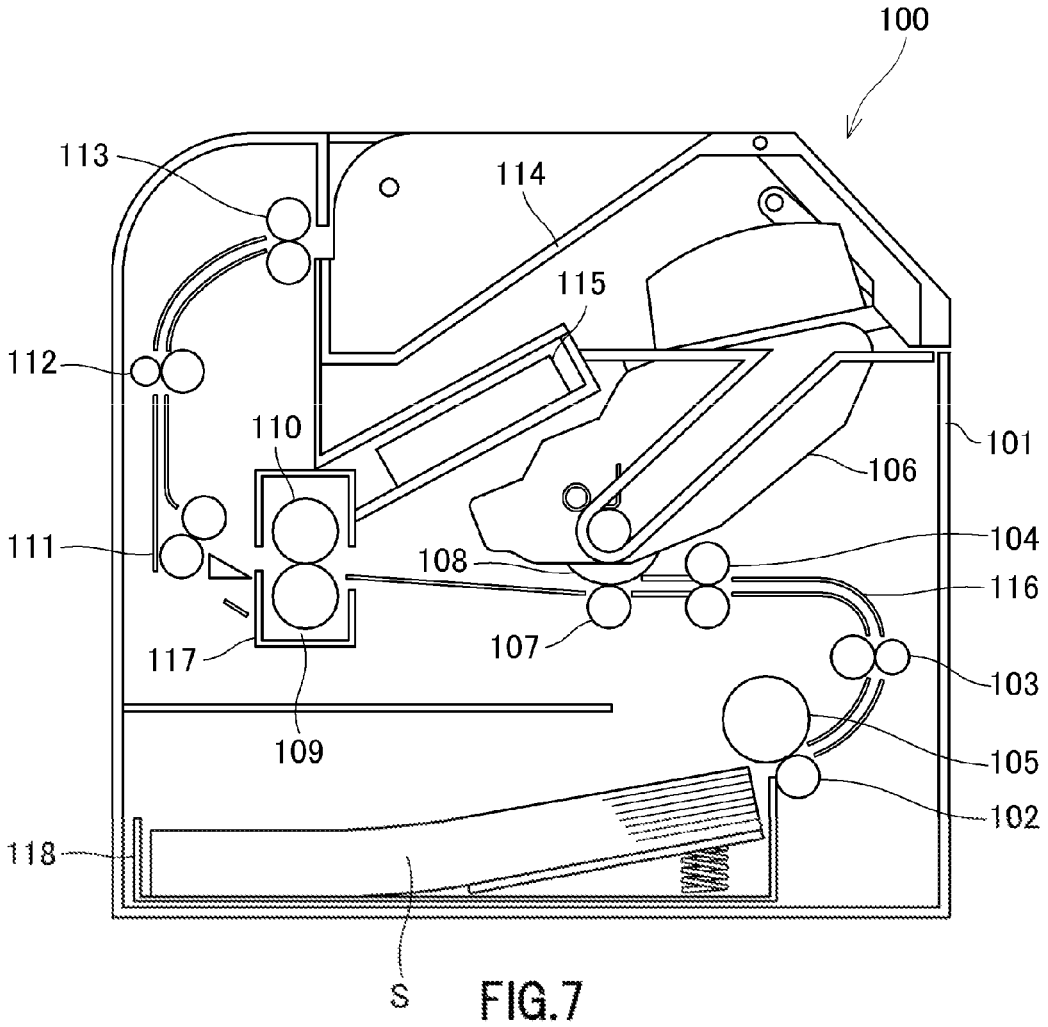
FIG. 7 is a cross-sectional view illustrating a schematic configuration of the image forming apparatus of the first embodiment.

FIG. 7 is a cross-sectional view illustrating a schematic configuration of an image forming apparatus of this embodiment.

An image forming operation of an image forming apparatus 100 of this embodiment will be described using FIG. 7.

First, a drum-shaped electrophotographic photoreceptor (hereinafter, photosensitive drum) 108 is irradiated with a laser beam according to the image information obtained from an external device (not illustrated), by an exposure device 115 which includes a laser diode, a polygon mirror, a lens and a reflecting mirror. Thus, a latent image (electrostatic latent image) according to the image information is formed on the photosensitive drum 108. The latent image is developed by a developing means configured inside a process cartridge 106.

A sheet S as a recording medium (recording material) is stacked in a feeding tray 118 in a lower part of the image forming apparatus 100, the sheet S sent out by a feeding roller 105 is separated into each sheet by a separating unit 102 and the sheet is conveyed along a conveyance guide member 116. The sheet S in the feeding tray 118 is sent to a conveyance roller pair 103 disposed at a downstream side of the separating unit 102 and is further conveyed to a registration roller pair 104 disposed on the downstream side thereof, and the correction of the skew is performed here. Next, the sheet S is conveyed to a transfer nip portion by the registration roller pair 104, in accordance with the timing at which the latent image on the photosensitive drum 108 reaches a transfer nip portion (transfer position) between the photosensitive drum 108 and the transfer roller 107.

In the transfer nip portion, the transfer roller 107 as a transfer means is disposed, and a voltage is applied to the transfer roller 107. Accordingly, the toner image on the photosensitive drum 108 is transferred onto the sheet S.

Thereafter, the sheet S onto which the toner image is transferred is conveyed to a fixing device 117 along the conveyance guide member 116. In the fixing device 117, a fixing process for fixing the toner image, which is transferred onto the sheet S, to the sheet S is performed. The fixing device 117 includes a pressure roller 109 and a fixing roller 110 having a built-in heater, and applies heat and pressure to the passing sheet S to fix the transferred toner image onto the sheet S.

The image forming apparatus 100 of this embodiment is provided to be able to execute a double-sided print mode of performing the double-sided printing to the sheet S and a single-sided print mode. In the case of the single-sided print mode, the sheet S after the fixing process is conveyed to the discharge roller pair 113 by the conveyance roller pairs 111 and 112, and is discharged onto a discharge tray 114 outside the apparatus by the discharge roller pair 113.

A display panel 41, which will be described later, is a display and operation panel unit which has a display unit illustrated later and an input key unit used for performing an operation by an operator. The display unit is intended to display information which enables to perform the required operation and to instruct an operator (a user and a worker) on an operating method of the apparatus, such as the toner replenishment and the removal of the jammed sheet S. Here, the display panel 41 corresponds to an operating unit in which input operation of information is performed.

In this embodiment, as illustrated in FIGS . 1A to 1D, in order to reduce the size of the product, the display panel 41 is disposed so as not to protrude from the outer shape (exterior) of the image forming apparatus main body (hereinafter, an apparatus main body) 101.

(Configuration of Opening and Closing Cover and Display Panel)

In the image forming apparatus 100 of this embodiment, the configuration of each member that operates in conjunction with the opening and closing operation of a first cover 42 as an opening and closing cover will be described below with reference to FIGS. 1A to 1D.

Figure 1B:
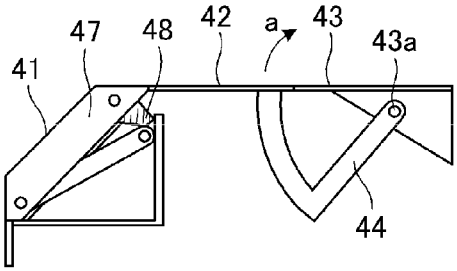
Figure 1C:
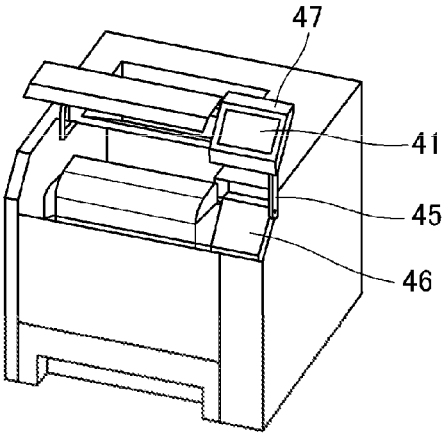
Figure 1D:
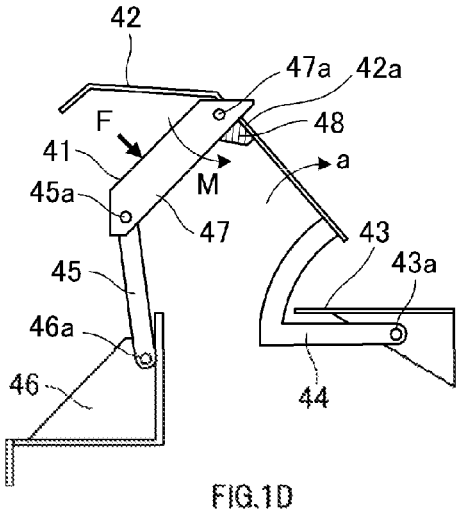

FIG. 1A is a schematic perspective view illustrating a state in which the first cover 42 takes a closed position (hereinafter, a closed state). FIG. 1C is a schematic perspective view illustrating a state in which the first cover 42 takes an open position (a fully open state, hereinafter, an open state). FIGS. 1B and 1D are schematic diagrams illustrating the display panel 41 and the first cover 42 from the right side direction when the display panel 41 is set to a front (front side) in the image forming apparatus 100 illustrated in FIGS. 1A and 1C, respectively. The first cover 42 is opened and closed during the exchange of the process cartridge 106 and the jam treatment. Here, the first cover 42 is provided so as to be movable with respect to the apparatus main body 101, and corresponds to the opening and closing member which opens and closes the inside of the apparatus main body.

The display panel 41 of this embodiment is provided integrally with the second link member 47, and in the closed state of the first cover 42, as illustrated in FIG. 1A, the display panel 41 is disposed to be adjacent to the first cover 42. Here, the second link member 47 corresponds to a movable member.

In this embodiment, the second link member 47 is connected to the first cover 42 to be movable in conjunction with the opening and closing operation of the first cover 42. Moreover, the second link member 47 is configured to move in conjunction with the opening operation of the first cover 42 to be able to open the inside of the apparatus main body 101 together with the first cover 42.

Thus, when the operator opens the first cover 42, the second link member 47 having the display panel 41 disposed thereon moves in conjunction with the opening operation of the first cover 42, and each of the first cover 42 and the second link member 47 enters the open state as illustrated in FIG. 1C. Thus, an opening portion for opening the inside of the apparatus main body 101 of the image forming apparatus 100 is formed, and the replacement work or the like of the process cartridge 106 becomes possible.

At this time, the display panel 41 is configured to move to a position at which the first cover 42 and the second link member 47 enter the open position as illustrated in FIG. 1C, while substantially maintaining a posture (angle) in which the operator easily sees the display panel from the front.

This is due to the fact that, by constituting a link mechanism so that a plurality of link members including the first cover 42 and the second link member 47 are rotatably connected to each other, the second link member 47 is movably connected to the apparatus main body 101. In this embodiment, the second link member 47 moves, while changing the posture to the first cover 42 so that the facing direction of the display panel 41 is kept in a predetermined direction (a direction facing the outside of the apparatus main body 101), in conjunction with the movement of the first cover 42.

This will be described in more detail below. Further, since the second link member 47 is also opened when opening the first cover 42, in the following description, in some cases, the open state of the first cover 42 and the second link member 47 is also referred to as the open state of only the first cover 42.

In this embodiment, the apparatus main body 101, the first cover 42, the second link member 47 and the first link member 45 form a four-link mechanism. Here, the first link member 45 corresponds to a connecting member.

That is, as illustrated in FIG. 1D, each of the first cover 42 and the first link member 45 is rotatably connected and supported (pivotally supported) with respect to the apparatus main body 101, and the second link member 47 is rotatably connected and supported with respect to each of the first cover 42 and the first link member 45.

Here, in this embodiment, as illustrated in FIG. 1D, an arm member 44 is provided integrally with the first cover 42, and the arm member 44 is rotatably supported and connected around a rotary shaft 43*a* as a center of rotation with respect to the apparatus main body 101. Thus, the first cover 42 is rotatably connected and supported with respect to the apparatus main body 101. Moreover, when the opening and closing operation of the first cover 42 is performed, the arm member 44 rotates with respect to the apparatus main body 101.

Further, the first link member 45 is rotatably connected and supported by a rotary shaft 46*a* with respect to abase member 46 provided on the apparatus main body 101.

The second link member 47 is rotatably connected and supported with respect to the first cover 42 by a rotary shaft 47*a* at one end side, and is rotatably connected and supported with respect to the first link member 45 by a rotary shaft 45*a* at the other end side. As a method for connecting the two link members that form the link mechanism, as an example, it is possible to adopt a method for connecting the rotary shaft and a bearing, by providing one link member with a rotary shaft and providing the other link member with the bearing. At this time, the rotary shaft may be provided integrally with one link member and may be provided as a separate body.

When the first cover 42 is opened, it rotates in the direction of arrow a (clockwise direction) in FIG. 1B around the rotary shaft 43*a* as the center of rotation. When the first cover 42 rotates, the second link member 47 and the first link member 45 move in conjunction with the movement of the first cover 42. At this time, the second link member 47 rotates with respect to the first cover 42 around the rotary shaft 47*a* as the center of rotation, and rotates with respect to the first link member 45 around the rotary shaft 45*a* as the center of rotation. Further, the first link member 45 rotates with respect to the second link member 47 around the rotary shaft 45*a* as the center of rotation, and rotates with respect to the base member 46 (the apparatus main body 101) around the rotary shaft 46*a* as the center of rotation. In this way, the first cover 42 rotates in the direction of the arrow a in FIG. 1D, until it enters the open state illustrated in FIG. 1D.

With such a link mechanism, the display panel 41 can maintain a posture (angle) in which the operator easily sees the display panel, even in the open state of the first cover 42.

Here, a second cover 43 illustrated in FIGS. 1A to 1D constitutes a top cover of the apparatus main body 101.

A characteristic configuration of this embodiment will be described below.

This embodiment is characterized in that a protruding portion 48 as a bumping portion is formed on the second link member 47.

In this embodiment, as illustrated in FIGS. 1A and 1C, the second link member 47 is disposed alongside the first cover 42 in the direction of rotary shaft, and the protruding portion 48 is formed so as to protrude in the direction of rotary shaft toward the first cover 42 from the main body portion of the display unit 41. The protruding portion 48 does not abut against the first cover 42 in the closed state of the first cover 42, as illustrated in FIG. 1B.

The protruding portion 48 is formed so that, when the first cover 42 is opened from the closed state, the first cover 42 rotates in the direction of the arrow a illustrated in FIG. 1D, and the protruding portion 48 bumps (abuts) against a bumped portion 42*a* of the first cover 42. At this time, since the protruding portion 48 bumps against the bumped portion 42*a*, further movement of the second link member 47 with respect to the first cover 42 is restricted (limited, and blocked).

Thus, since the protruding portion 48 and the bumped portion 42*a* bump against each other, the first cover 42 and the second link member 47 enter the open state.

Figure 8A:
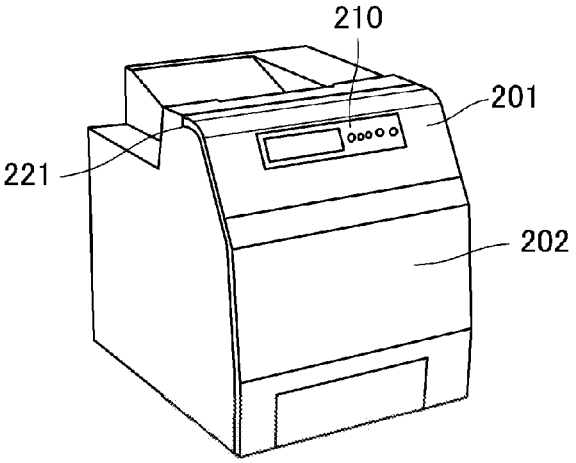
FIGS. 8A to 8C are schematic diagrams illustrating a conventional example.
Figure 8B:
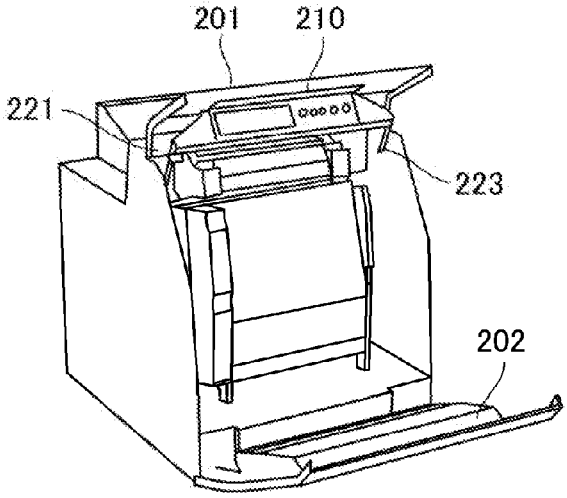
Figure 8C:
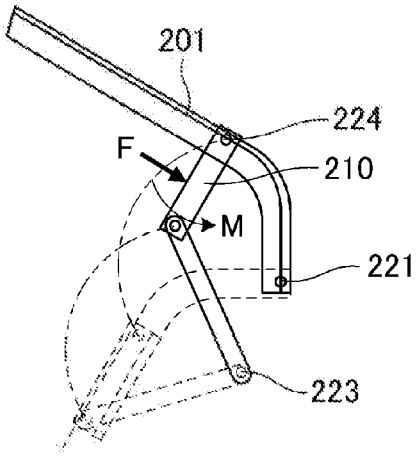

Here, in the conventional forms as illustrated in FIGS. 8A to 8C, when the operator gives force F to the display panel 210 in the open state of the upper cover member 201 (FIG. 8B), the moment M centered on the rotary shaft 224 acts on the display panel 210 (FIG. 8C). There is a concern that the display panel 210 may be tilted with respect to the upper cover member 201 due to this force. Moreover, there is a concern that there may be a situation which makes it difficult for the operator to operate the display panel 210 by tilting.

In contrast, even in this embodiment, when the first cover 42 is in the open state, if the display panel 41 is pressed with a force F by the operator (input operation is performed), the moment M acts around the rotary shaft 47*a* (FIG. 1D). At this time, in this embodiment, the protruding portion 48 of the second link member 47 bumps against the bumped portion 42*a* of the first cover 42, and when the display panel 41 is pressed in this state, the force is applied in the direction in which the protruding portion 48 and the bumped portion 42*a* bump against each other. For this reason, by the reaction force caused by the protruding portion 48 and the bumped portion 42*a* bumping against each other, the moment M is offset.

Thus, in the open state of the first cover 42, when the operator operates the display panel 41 by pressing, the moment M acting on the display panel 41 (the second link member 47) is offset by the reaction force. For this reason, the display panel 41 is able to maintain the rigidity without tilting or deformation.

As described above, in this embodiment, in the image forming apparatus having the display panel 41, which is movable in conjunction with the opening and closing cover (first cover 42), the following configuration is provided.

That is, in the open state of the first cover 42, the protruding portion 48 and the bumped portion 42*a* bump against each other. Thus, by movement of the display unit 41 in the pressed direction, the movement of the second link member 47 in the direction of being further opened with respect to the first cover 42 is restricted.

Thus, in the open state of the first cover 42, since the second link member 47 is in the state of abutting against the first cover 42, it is possible to improve the rigidity of the second link member 47. Thus, in the open state of the first cover 42, even when the operator operates the display panel 41 by pressing, the display panel 41 is able to maintain the rigidity without tilting or deformation.

Here, this embodiment has described a form in which the protruding portion 48 is provided in the second link member 47 and the bumped portion 42*a* is provided in the first cover 42, but is not limited thereto. The protruding portion (bumping portion) may be provided in the first cover 42, and the bumped portion may be provided in the second link member 47. Also, the shapes and the positions of the bumping portion and the bumped portion are not also particularly limited. A portion (region), which restricts the movement of the second link member 47 in the direction of being further opened with respect to the first cover 42 by bumping against each other, may be provided between the first cover 42 and the second link member 47.

Further, the display panel 41 has a configuration which includes a display unit and an input key unit, but it is not limited thereto. That is, the display panel 41 may not have the display function and may have an operating unit used for performing the input operation of information by the operator. If the force is applied to the second link member 47 in the further opening direction (F direction in FIG. 1D) in the open state of the first cover 42, it is possible to suitably apply the present invention.

Further, this embodiment has described a form in which the first cover 42 and the second link member 47 constitute a four-link mechanism, but it is not limited thereto. That is, the present invention can also be suitably applied to a form in which a plurality of link members including the first cover 42 and the second link member 47 are rotatably connected to constitute a link mechanism, and the first cover 42 and the second link member 47 are movable with respect to the apparatus main body 101.

Further, this embodiment has described a form in which the display panel 41 moves while changing the posture with respect to the first cover 42 so that the facing direction of the display panel 41 is maintained in a predetermined direction, but it is not limited thereto. In this embodiment, since it is possible to improve the rigidity of the second link member 47 and the display panel 41 in the open state of the first cover 42, at this time, the facing direction of the display panel 41 is not particularly limited.

Second Embodiment

A second embodiment will be described below. In this embodiment, components different from those of the first embodiment will be described, and the same components as those of the first embodiment will not be described.

In this embodiment, the rigidity of the display panel 41 in the practical use is further stronger than that of the first embodiment.

Figure 2:
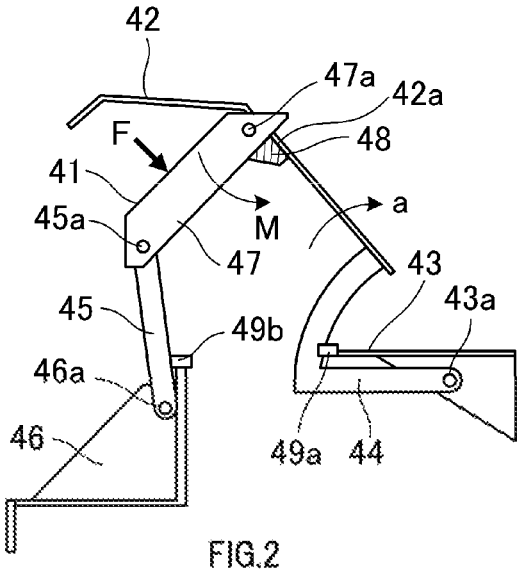
FIG. 2 is a schematic diagram illustrating main parts of an image forming apparatus of a second embodiment.

FIG. 2 is a schematic diagram illustrating main parts of an image forming apparatus 100 of this embodiment.

In the first embodiment, when the force F illustrated in FIG. 1D strongly acts on the upper side of the display panel 41, there is a concern that the force transmitted to the arm member 44 increases, and the arm member 44 is bent until it bumps against the second cover 43. Also, when the force F strongly acts on the lower side of the display panel 41, there is a concern that the force transmitted to the first link member 45 increases, and the first link member 45 is bent until it bumps against the base member 46.

There is a concern that rattling occurs between the arm member 44 or the first link member 45 and the apparatus main body 101 side due to bending of the arm member 44 or the first link member 45.

To improve this problem, in this embodiment, an abutment portion 49*a* abutting (bumping) against the arm member 44 and an abutment portion 49*b* abutting against the first link member 45 in the open state of the first cover 42 are disposed in the apparatus main body 101, respectively.

As illustrated in FIG. 2, when the first cover 42 is opened, the first cover 42 rotates around the rotary shaft 43*a* as a center of rotation in the direction of the arrow a until the bumped portion 42*a* of the first cover 42 abuts against the protruding portion 48 of the second link member 47.

Moreover, when the bumped portion 42*a* of the first cover 42 abuts against the protruding portion 48 of the second link member 47 and the first cover 42 enters the open state, the arm member 44 abuts against the abutment portion 49*a*, and the first link member 45 abuts against the abutment portion 49*b*. Here, a portion, which abuts against the abutment portion 49*a*, of the arm member 44 functions as an abutment portion, and the abutment portion and the abutment portion 49*a* correspond to first abutment portions which abut against each other. Further, a portion, which abuts against the abutment portion 49*b*, of the first link member 45 functions as an abutment portion, and the abutment portion and the abutment portion 49*b* correspond to second abutment portions which abut against each other. The first abutment portions may be configured to abut against each other between the two members, and the shapes of the abutment portions provided in each member are not limited. The same is also applied to the second abutment portions.

With this configuration, in the open state of the first cover 42, the display panel 41, the second link member 47, the protruding portion 48, the first cover 42, the arm member 44, the first link member 45 and the second cover 43 (apparatus main body 101) are integrated.

Thus, in this embodiment, it is possible to maintain the rigidity of the display panel 41 in the open state of the first cover 42 to be stronger than the configuration of the first embodiment.

Thus, it is possible to prevent an occurrence of rattling of the arm member 44 and the first link member 45 which is a concern when the display panel 41 is pressed by the operator in the open state of the first cover 42.

Third Embodiment

A third embodiment will be described below. In addition, in this embodiment, the components different from those of the first and second embodiments will be described, and the same components as those of the first and second embodiments will not be described.

In this embodiment, fitting portions fitted to each other in the open state of the first cover 42 are provided between the second link member 47 and the first cover 42, and fitting portions fitted to each other in the closed state of the first cover 42 are provided between the second link member 47 and the apparatus main body 101.

Figure 3A:
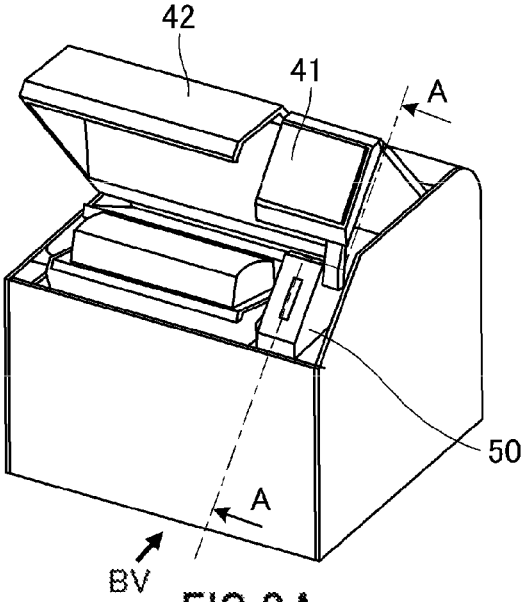
FIGS. 3A to 3D are diagrams for illustrating the features of an image forming apparatus of a third embodiment.
Figure 3B:
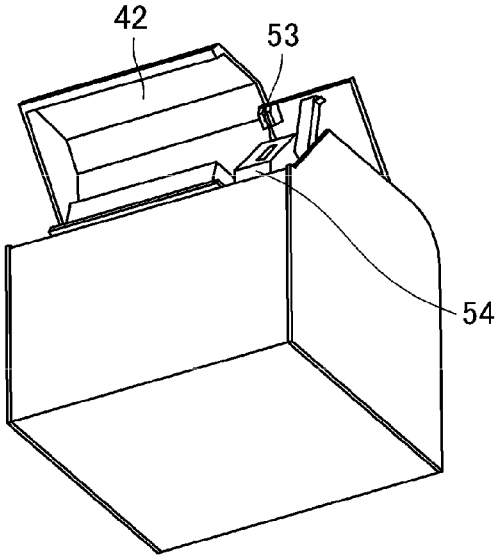
Figure 3C:
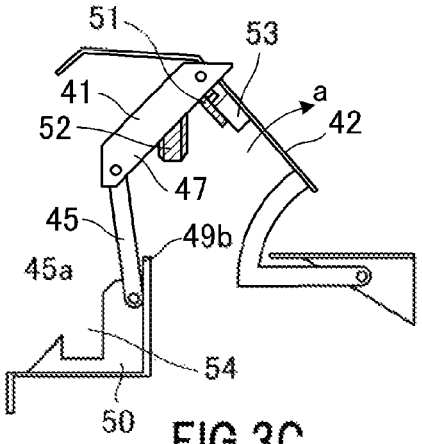
Figure 3D:
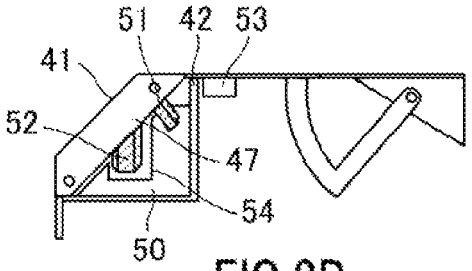

FIG. 3A is a schematic perspective view illustrating an image forming apparatus 100 of this embodiment. FIG. 3B is a schematic perspective view when main parts of the image forming apparatus 100 are viewed from a direction of arrow BV in FIG. 3A. In FIG. 3B, for convenience of explanation, a display panel 41 is not illustrated. FIGS. 3C and 3D are schematic cross-sectional views illustrating a cross section taken from a line A-A of FIG. 3A, and illustrate a fully open state and a closed state, respectively.

In this embodiment, as illustrated in FIGS. 3A and 3B, a first groove 53 is provided in the first cover 42, and a second groove 54 is provided in an inner cover 50 of the apparatus main body 101. Moreover, as illustrated in FIGS. 3C and 3D, the second link member 47 has a first protruding portion 51 provided so as to be able to be fitted into the first groove 53, and a second protruding portion 52 provided so as to be able to be fitted into the second groove 54.

Here, the first protruding portion 51 corresponds to the bumping portion, the first groove 53 corresponds to the bumped portion. Further, the second protruding portion 52 and the second groove 54 correspond to a mutual fitting portion. Each fitting portion may be configured to be fitted with each other between the two members, and the shapes of the fitting portions provided in each member are not limited. For example, in this embodiment, although the first groove 53 is provided in the first cover 42 and the first protruding portion 51 is provided in the second link member 47, the protruding portion may be provided in the first cover 42, and the groove may be provided in the second link member 47.

As illustrated in FIG. 3C, when the first cover 42 is opened, the first cover 42 rotates around the rotary shaft 43*a* as a center of rotation in the direction of arrow a, until the first protruding portion 51 provided in the second link member 47 abuts against the first cover 42.

Moreover, the first protruding portion 51 of the second link member 47 is fitted to the first groove 53 of the first cover 42. At this time, the first cover 42 and the second link member 47 enter the open state. With this configuration, it is possible to perform the positioning of the second link member 47 with respect to the first cover 42. In this embodiment, the fitting portion is constituted by the grooves and the protruding portions, and the grooves (protruding portions) are configured to extend in a direction which intersects with the direction of the rotary shaft of the second link member 47.

Thus, when the first cover 42 is set to the open state, the first protruding portion 51 and the first groove 53 bump against each other, and with respect to the direction of the rotary shaft of the second link member 47 which is a direction intersecting with the pressing direction by the operator of the display unit 41, the position of the second link member 47 to the first cover 42 is restricted. Thus, in the open state of the first cover 42, with respect to the direction of the rotary shaft of the second link member 47, it is possible to more reliably perform the positioning of the second link member 47 to the first cover 42.

Thus, when the first cover 42 is opened, it is possible to further improve the rigidity of the display panel 41 to the direction of the rotary shaft when the operator operates the display panel 41, and the second link member 47 does not rattle in the direction of rotary shaft with respect to the first cover 42.

Further, along with the closing operation of the first cover 42, the fitting state between the first protruding portion 51 of the second link member 47 and the first groove 53 of the first cover 42 is released. Moreover, in the closed state of the first cover 42, the second protruding portion 52 of the second link member 47 is fitted to the second groove 54 of the inner cover 50. In this embodiment, the fitting portion is also constituted by the groove and the protruding portion, and the groove (protruding portion) is configured to extend in a direction which intersects with the direction of the rotary shaft of the second link member 47.

Thus, when the first cover 42 is in the closed state, with respect to the direction of the rotary shaft of the second link member 47 which is a direction intersecting with the pressing direction by the operator of the display unit 41, the position of the second link member 47 to the first cover 42 and the inner cover 50 of the apparatus main body 101 is restricted. Thus, in the closed state of the first cover 42, with respect to the direction of the rotary shaft of the second link member 47, it is possible to more reliably perform the positioning of the second link member 47 to the first cover 42 and the inner cover 50. Thus, when the first cover 42 is in the closed state, it is possible to further improve the rigidity of the display panel 41 with respect to the direction of the rotary shaft when the operator operates the display panel 41.

Here, in addition to the configuration of this embodiment, a member corresponding to the abutment portions 49*a* and 49*b* of the second embodiment may be disposed.

Fourth Embodiment

A fourth embodiment will be described below. In this embodiment, the components different from those of the first to third embodiments will be described, and the same components as those of the first to third embodiments will not be described.

This embodiment has a configuration in which the rotary shafts 45*a* and 47*a* of the link mechanism are pivotally supported by the side member 40 as a side surface (side wall) of the apparatus main body 101.

Figure 4A:
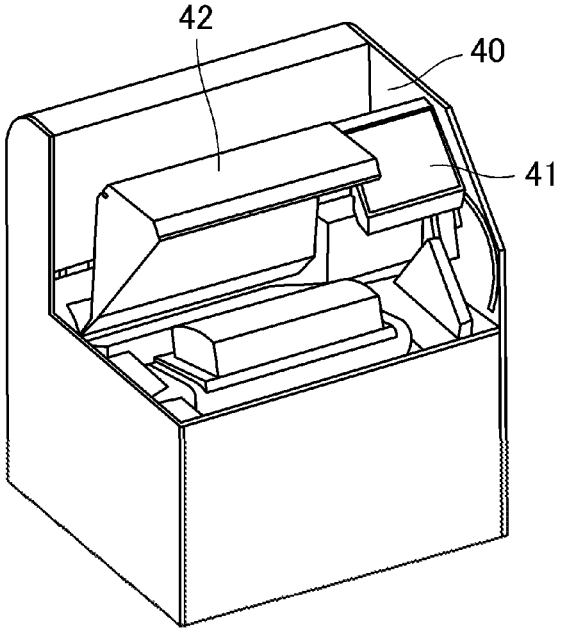
FIGS. 4A and 4B are diagrams for illustrating features of an image forming apparatus of a fourth embodiment.
Figure 4B:
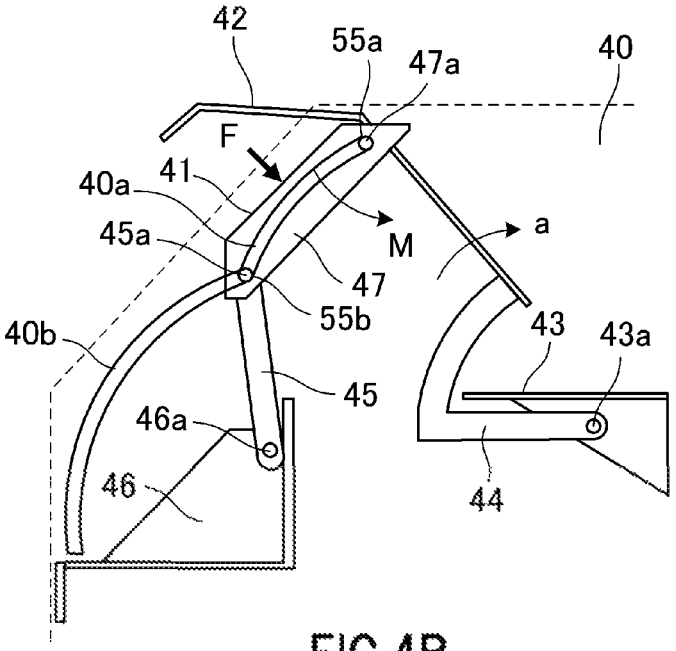

FIG. 4A is a schematic perspective view illustrating an image forming apparatus 100 of this embodiment, and FIG. 4B is a schematic cross-sectional view illustrating the main parts of the image forming apparatus 100 when the first cover 42 is in the open state.

In this embodiment, the external portion of the image forming apparatus 100 is configured to include a first cover 42, a second link member 47 provided with a display panel 41, and a side member 40. Moreover, a rotary shaft 45*a* as a connecting portion between the first link member 45 and the second link member 47, and a rotary shaft 47*a* as a connecting portion between the second link member 47 and the first cover 42 are pivotally supported on the side member 40.

As illustrated in FIG. 4B, the side member 40 is provided with notches (grooves) 40*a* and 40*b* along a trajectory (movement trajectory) of the rotary shafts 47*a* and 45*a* which move in conjunction with the opening and closing operation of the first cover 42. In this embodiment, the rotary shafts 47*a* and 45*a* are configured to be always pivotally supported (guided) on the notches 40*a* and 40*b* in the process of the opening and closing operation of the first cover 42.

Further, abutment portions 55*a* and 55*b* are provided in each of the end portions of the notches 40*a* and 40*b*. When the first cover 42 is in the open state, the rotary shafts 47*a* and 45*a* abut against the abutment portions 55*a* and 55*b*. Here, the rotary shafts 47*a* and 45*a* correspond to the bumping portions, and the abutment portions 55*a* and 55*b* of the side members 40 correspond to the bumped portions corresponding to the respective bumping portions. Further, the notches 40*a* and 40*b* correspond to the guide portions. Further, the first link member 45 corresponds to one member of the plurality of link members.

As illustrated in FIG. 4B, when the first cover 42 is opened, the first cover 42 rotates around the rotary shaft 43*a* as a center of rotation in the direction of the arrow a. Moreover, after the rotary shaft 47*a* is guided by the notch 40*a*, by the abutment with the abutment portion 55*a*, the first cover 42 enters the open state.

Then, when the first cover 42 is in the open state, if the display panel 41 is pressed with the force F by the operator, the moment M acts around the rotary shaft 47*a*. At this time, in this embodiment, since the rotary shaft 47*a* is in the state of abutting against the abutment portion 55*a*, the moment M is offset by the reaction force caused by the abutment between the rotary shaft 47*a* and the abutment portion 55*a*.

In this way, even in this embodiment, when the operator operates the display panel 41 by pressing in the open state of the first cover 42, the moment M acting on the display panel 41 is offset by the reaction force. For this reason, the display panel 41 is able to maintain the rigidity without tilting or deformation.

Therefore, similarly to the first embodiment, even in this embodiment, in the open state of the first cover 42, a state of improved rigidity of the second link member 47 is achieved. Thus, even if the operator operates the display panel 41 by pressing in the open state of the first cover 42, the display panel 41 is able to maintain the rigidity, without tilting or deformation.

Furthermore, in this embodiment, when the first cover 42 is opened, the rotary shaft 45*a* is also guided by the notch 40*b* and abuts against the abutment portion 55*b* in the open state of the first cover 42.

Thus, in the open state of the first cover 42, the rigidity of the second link member 47 can be further improved, and it is also possible to suppress the rattling which is a concern to occur in the first link member 45. Therefore, in the open state of the first cover 42, it is possible to maintain the rigidity of the display panel 41 (the second link member 47) to be stronger than the first embodiment.

Here, in this embodiment, the rotary shafts 47*a* and 45*a* are always pivotally supported by the notches 40*a* and 40*b*, in the process of the opening and closing operation of the first cover 42, but it is not limited thereto. As long as the first cover 42 may enter the open state by the abutment of the rotary shafts 47*a* and 45*a* against the abutment portions 55*a* and 55*b*, a configuration, in which the rotary shafts 47*a* and 45*a* are not always pivotally supported by the notches 40*a* and 40*b* in the process of the opening and closing operation of the first cover 42, may be provided.

Also, in this embodiment, although the rotary shaft 47*a* is applied as a bumping portion, but it is not limited thereto, and the bumping portion may be a member which is disposed coaxially with the rotary shaft 47*a* (the center of rotation of the second link member 47 with respect to the first cover 42). Also, the bumping portion may cause the first cover 42 to enter the open state by abutting against the abutment portion 55*a* of the side member 40, and may not be disposed coaxially with the rotary shaft 47*a*.

Also, in addition to the configuration of this embodiment, the configurations described in the first to third embodiments may be appropriately applied. For example, in the configuration of this embodiment, members corresponding to the protruding portion 48 and the bumped portion 42*a* of the first embodiment may be disposed, and members corresponding to the abutment portions 49*a* and 49*b* of the second embodiment may be disposed. Also, the abutment portions 55*a* and 55*b* may be configured to be able to fit the rotary shafts 47*a* and 45*a*.

Fifth Embodiment

A fifth embodiment will be described below. In addition, in this embodiment, components different from those of the first embodiment will be described, and the same components as those of the first embodiment will not be described.

First, the subject of this embodiment will be described in detail.

FIGS. 6A1 to 6C2 are schematic diagrams for illustrating the subject of this embodiment. FIG. 6A1 is a schematic diagram illustrating an open state of the first cover 42, and FIG. 6A2 is an enlarged view of a region surrounded by a square C in FIG. 6A1. FIGS. 6B1 and 6C1 are schematic perspective views illustrating a front portion of the image forming apparatus, and FIGS. 6B2 and 6C2 are enlarged views of the regions surrounded by squares D and E in each of FIGS. 6B1 and 6C1.

As illustrated in FIGS. 6A1 and 6A2, a case is assumed in which a connecting portion between the first link member 45 and the second link member 47 is always in the fitting state. At this time, when the first cover 42 is in the closed state, an abutment portion (bumping portion) 42*e* of the first cover 42, and an abutment portion 47*e* of the second link member 47 are positioned by abutting against a front cover 55 which is disposed in front (front side) of the apparatus main body 101.

Here, in the first link member 45, when the distance from the rotary shaft 45*a* to the rotary shaft 46*a* is shorter by the tolerance of the components, the abutment portion 42*e* abuts against the front cover 55 earlier than the abutment portion 47*e*. For this reason, the first cover 42 cannot be closed to a predetermined (original) position, and there is a concern that a step may occur between the first cover 42 and the second link member 47 (FIGS. 6B1 and 6B2).

Meanwhile, in the first link member 45, when the distance from the rotary shaft 45*a* to the rotary shaft 46*a* is longer by the tolerance of the components, the abutment portion 47*e* abuts against the front cover 55 earlier than the abutment portion 42*e*. For this reason, the second link member 47 cannot be closed to a predetermined position, and there is a concern that a step may occur between the first cover 42 and the second link member 47 (FIGS. 6C1 and 6C2).

Moreover, due to an occurrence of the step between the first cover 42 and the second link member 47, the display panel 41 floats in the air, and there is a concern that the rigidity on operating the display panel 41 may be lowered.

Here, when the operator operates the display panel 41 by pressing in the open state of the first cover 42, it is possible to maintain the rigidity without tilting or displacement of the display panel 41 to the first cover 42.

Figure 5A:
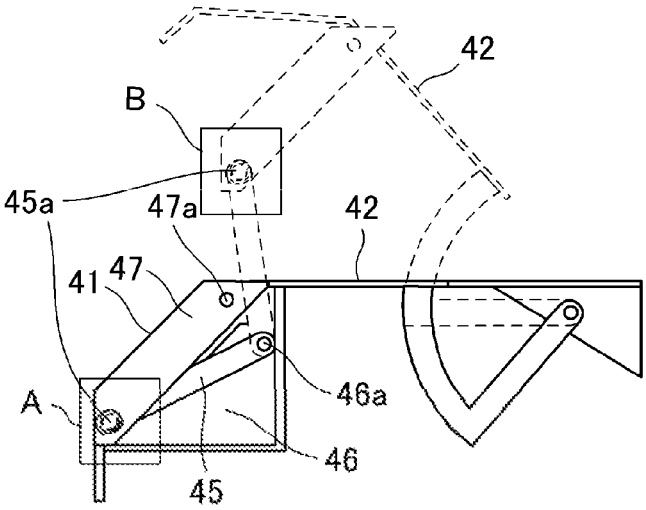
FIGS. 5A to 5C are schematic diagrams illustrating main parts of an image forming apparatus of a fifth embodiment.
Figure 5B:
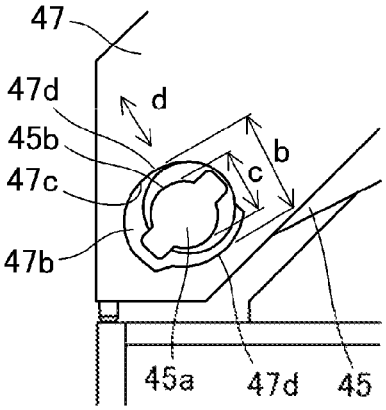
Figure 5C:
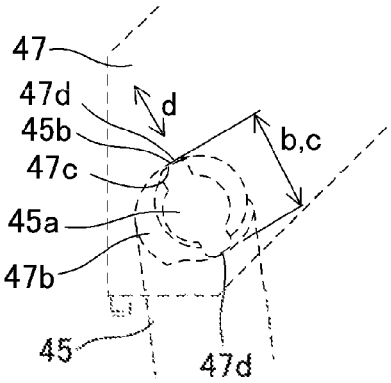

FIGS. 5A to 5C are schematic diagrams illustrating the main parts of the image forming apparatus of this embodiment.

FIG. 5A illustrates a closed state of the first cover 42 by a solid line and illustrates an open state by a dotted line. FIGS. 5B and 5C illustrate enlarged views of the portions surrounded by squares A and B of FIG. 5A.

As features of this embodiment, the connecting portion between the first link member 45 and the second link member 47 is configured so that the rotary shaft 45*a* of the first link member 45 and a fitting bore (hole) 47*b* of the second link member 47 are loosely fitted to each other. Moreover, the rotary shaft 45*a* of the first link member 45 and the fitting bore 47*b* of the second link member 47 are configured so that the rotary shaft 45*a* and the fitting bore 47*b* relatively rotate, along with the opening and closing operation of the first cover 42.

Also, as illustrated in FIGS. 5B and 5C, in the fitting bore 47*b*, predetermined portions facing each other with the rotary shaft 45*a* interposed there between is a pair of facing portions 47*d*.

At this time, a dimensional difference between an interval b between the pair of facing portions in the facing direction d of the pair of facing portions 47*d* of the direction perpendicular to the rotary axial center of the rotary shaft 45*a*, and a width c of the rotary shaft 45*a* between the pair of facing portions is configured as follows. That is, the dimensional difference between the interval b and the width c is configured so that the dimensional difference of the open state of the first cover 42 is smaller than that of the closed state. In this embodiment, in the open state of the first cover 42, there is no dimensional difference between the interval b and the width c, and the rotary shaft 45*a* is configured to be fitted between the pair of facing portions 47*d* of the fitting bore 47*b*.

This is because the width of the rotary shaft 45*a* in the facing direction d is configured so that the width in the open state of the first cover 42 is greater than that in the closed state. Here, the rotary shaft 45*a* corresponds to the rotating member, and the fitting bore 47*b* corresponds to the loose-fit portion.

With this configuration, as illustrated in FIG. 5B, in the closed state of the first cover 42, with respect to the opening and closing direction (d direction) of the display panel 41 in the closed state of the first cover 42, a gap (backlash) is generated between a shaft outer circumferential portion 45*b* of the rotary shaft 45*a* of the first link member 45 and a bore inner circumferential surface 47*c* of the fitting bore (hole) 47*b* of the second link member 47.

Thus, in the closed state of the first cover 42, since the second link member 47 can be operated (moved) in the closing direction as much as a gap generated between the second link member 47 and the rotary shaft 45*a*, the first cover 42 and the second link member 47 can be closed to a predetermined position.

As a result, as described in FIGS. 6A1 to 6C2, a step is not generated between the first cover 42 and the second link member 47.

Thus, when the operator operates the display panel 41 by pressing in the closed state of the first cover 42, the display panel 41 can maintain the rigidity without being tilted or displaced with respect to the first cover 42 (apparatus main body 101), and problems of appearance also do not occur.

Meanwhile, in the open state of the first cover 42, as illustrated in FIG. 5C, with respect to the direction (d direction) in which the display panel 41 in the closed state of the first cover 42 is pressed by the user, the rotary shaft 45*a* is configured to be fitted between a pair of facing portions 47*d* of the fitting bore 47*b*. Thus, there is no gap (backlash) between the shaft outer circumferential portion 45*b* and the bore inner circumferential surface 47*c*. In addition, there may be a gap (backlash) between the shaft outer circumferential portion 45*b* and the bore inner circumferential surface 47*c* in the open state of the first cover 42. In this case, it may be smaller than the gap (backlash) between the shaft outer circumferential portion 45*b* and the bore inner circumferential surface 47*c* in the opening and closing direction (d direction) of the display panel 41 in the closed state of the first cover 42.

As a result, in the open state of the first cover 42, since the first cover 42 and the second link member 47 enter the reliably fitted state, it is possible to improve the rigidity of the second link member 47. Thus, when the operator operates the display panel 41 by pressing in the open state of the first cover 42, the display panel 41 can maintain the rigidity without being tilted or displaced with respect to the first cover 42.

Here, in this embodiment, the first link member 45 has a bore shape and a second link member 47 has a shaft shape, but it is not limited thereto, and even when the first link member 45 has a shaft shape and the second link member 47 has a bore shape, the same effects as described above can be obtained. Further, in this embodiment, when the first cover 42 is in the open state, there is no dimensional difference between the interval b and the width c, but it is not limited thereto. As long as the dimensional difference between the interval b and the width c is configured so that dimensional difference in the open state of the first cover 42 is smaller than that of the closed state, the same effects as described above can be obtained.

Also, in this embodiment, the shape of the connecting portion in the rotary shaft 45*a* has a cam shape, but it is not limited thereto, and it is possible to obtain the same effects even when using the cam shape in the connecting portion of the rotary shaft 46*a*. That is, the rotary shaft 46*a* of the first link member 45 may have a bore (or shaft) shape, and the rotary shaft 46*a* of the base member 46 may have a shaft (or bore) shape.

Further, in this embodiment, since the tolerance of the first link member 45 is taken into consideration, the shape of the connecting portion of the first link member 45 was intended to have the above-described shaft or bore shape. In the case of taking the tolerance of the other link members into consideration, such a shape may be appropriately applied to each of the connecting portions. Also, the form of forming the four-link mechanism has also been described in this embodiment, but it is not limited thereto. That is, the present invention can also be suitably applied to a form in which a plurality of link members including the first cover 42 and the second link member 47 are rotatably connected to form a link mechanism, and the first cover 42 and the second link member 47 are movable with respect to the apparatus main body 101. Further, the configuration of this embodiment may be provided in conjunction with the configurations of the first to fourth embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-091362, filed Apr. 25, 2014, which is hereby incorporated by reference herein in its entirety.

What is claimed is:

1. An image forming apparatus comprising:

an opening and closing member which is movably provided with respect to an apparatus main body of the image forming apparatus to open and close the inside of the apparatus main body; and a movable member which has an operating unit, in which a pressing operation is performed, and is movably connected with respect to the opening and closing member, wherein the movable member moves in conjunction with the opening and closing operation of the opening and closing member to be able to open and close the inside of the apparatus main body, together with the opening and closing member, and wherein the movable member includes a bumping portion, the opening and closing member includes a bumped portion, and the bumping portion abuts against the bumped portion in an open state of the opening and closing member, thereby restricting the movement of the movable member in a direction in which the operating unit is pressed, wherein the movable member moves, while changing a posture with respect to the opening and closing member so that a facing direction of the operating unit is maintained in a predetermined direction, when moving in conjunction with movement of the opening and closing member.

2. The image forming apparatus according to claim 1, wherein the movable member is pivotally supported on a rotary shaft so as to be rotatable with respect to the opening and closing member, and is disposed alongside the opening and closing member in the direction of the rotary shaft, and the bumping portion is provided to project from a main body of the movable member toward the bumped portion with respect to the direction of the rotary shaft.

3. The image forming apparatus according to claim 1, wherein the apparatus main body and the opening and closing member are provided with first abutment portions which abut against each other, when the bumping portion and the bumped portion bump against each other.

4. The image forming apparatus according to claim 1, further comprising:

a connecting member which movably connects the movable member to the apparatus main body, wherein the apparatus main body and the connecting member are provided with second abutment portions which abut against each other, when the bumping portion and the bumped portion bump against each other.

5. The image forming apparatus according to claim 1, wherein in a state in which the bumping portion and the bumped portion abut against each other, a position of the movable member to the opening and closing member with respect to a direction which intersects with the pressed direction of the operating unit is restricted.

6. The image forming apparatus according to claim 1, further comprising:

a connecting member connected to the movable member and the apparatus main body, wherein one of the movable member and the connecting member has a shaft, and the other thereof has a bore to which the shaft is inserted, and wherein the shaft rotates with respect to the bore in accordance with the movement of the opening and closing member, and backlash between the shaft and the bore in the opening and closing direction of the movable member at the closed position is greater than backlash between the shaft and the bore in the pressed direction of the operating unit at the open position.

7. An image forming apparatus comprising:

an opening and closing member which is movably provided with respect to an apparatus main body of the image forming apparatus to open and close the inside of the apparatus main body; and a movable member which has an operating unit, in which a pressing operation is performed, and is connected so as to be movable with respect to the opening and closing member, wherein the movable member moves in conjunction with the opening and closing operation of the opening and closing member to be able to open and close the inside of the apparatus main body, together with the opening and closing member, and wherein the movable member includes a bumping portion, the apparatus main body includes a bumped portion, and the bumping portion abuts against the bumped portion in an open state of the opening and closing member, thereby restricting the movement of the movable member in a direction in which the operating unit is pressed, wherein the movable member moves, while changing a posture with respect to the opening and closing member so that the facing direction of the operating unit is maintained in a predetermined direction, when moving in conjunction with movement of the opening and closing member.

8. The image forming apparatus according to claim 7, wherein the bumping portion is provided on the movable member, and the bumped portion is provided on a side wall provided in the apparatus main body.

9. The image forming apparatus according to claim 8, wherein the movable member is pivotally supported so as to be rotatable with respect to the opening and closing member, and the bumping portion is disposed coaxially with a center of rotation of the movable member with respect to the opening and closing member.

10. The image forming apparatus according to claim 9, wherein a guide portion configured to guide the bumping portion when the movable member moves is provided on the side wall, and when the opening and closing member is opened, the bumping portion is guided by the guide portion to bump against the bumped portion.

11. The image forming apparatus according to claim 8, wherein by forming a link mechanism through the rotatable connection of a plurality of link members including the opening and closing member and the movable member, the opening and closing member and the movable member are provided so as to be movable with respect to the apparatus main body, and one member of the plurality of link members and the opening and closing member are connected to the movable member, and the bumping portion is disposed coaxially with the center of rotation of the movable member with respect to the opening and closing member and coaxially with the center of rotation of the movable member with respect to the one member, respectively, and bumped portions corresponding to each bumping portion are provided on the side wall, respectively.

12. The image forming apparatus according to claim 11, wherein guide portions configured to guide each of the bumping portions when the movable member moves are provided on the side wall to correspond to each bumping portion, respectively, and when the opening and closing member is opened, each bumping portion is guided by each guide portion to bump against each bumped portion.

* * * * *